United States Patent [19]

Wilkinson

[11] Patent Number: 4,927,011

[45] Date of Patent: May 22, 1990

[54] STORAGE DEVICE FOR PERSONAL DENTAL HYGIENE AND ORAL CARE PRODUCTS

[76] Inventor: William T. Wilkinson, P.O. Box 378, Chesapeake City, Md. 21915

[21] Appl. No.: 432,224

[22] Filed: Nov. 6, 1989

[51] Int. Cl.[5] ..... A47B 49/00; A45D 40/00

[52] U.S. Cl. ..... 206/217; 206/581; 206/362.1; 211/65; 312/248; 248/309.2

[58] Field of Search ..... 206/362.1, 362.2, 362.3, 206/362, 209.1, 217, 581, 823; 211/65, 88; 248/309.2; 312/248, 246, 251, 284

[56] References Cited

U.S. PATENT DOCUMENTS

| | | | |
|---|---|---|---|
| 880,432 | 2/1908 | Weidhaas, Jr. | 206/209.1 |
| 1,228,261 | 5/1917 | Taylor | 206/362.1 X |
| 2,200,046 | 5/1940 | Straus | 211/65 X |
| 2,576,303 | 11/1951 | Matter | 211/88 X |
| 2,884,137 | 4/1959 | Lazzaro | 211/65 |
| 2,906,479 | 9/1959 | Strachan | 211/65 X |
| 2,956,851 | 10/1960 | Merendino | 206/362.1 X |
| 3,100,842 | 8/1963 | Tellefsen | 206/209.1 |
| 3,371,260 | 2/1968 | Jackson et al. | 206/362.1 X |
| 3,881,868 | 5/1975 | Duke | 206/209.1 |
| 3,966,055 | 6/1976 | Francavilla | 211/65 |

*Primary Examiner*—Paul T. Sewell
*Assistant Examiner*—Jacob K. Ackun, Jr.
*Attorney, Agent, or Firm*—Charles S. Knothe

[57] ABSTRACT

This invention discloses a storage system for personal care products used for dental hygiene and oral care. The device has a storage tube with an interior and exterior surface and two ends, one end closed and used as the base and the other end open. A toothbrush ring with outer and inner rims is mounted on the open end of the storage tube, the outer rim of toothbrush ring extends beyond the exterior surface of the storage tube and contains a plurality of apertures in which toothbrushes hang and the inner rim extends inside the interior surface of the storage tube. Inserted in the storage tube is a rinse cup with an exterior flange on the open end which catches the interior rim of the toothbrush ring. The rinse cup lid rests on the inner rim of the toothbrush ring covering the exterior flange of the rinse cup. Alternatively, the rinse cup lid is removably connected to the exterior rim of the toothbrush ring. An optional wall bracket can be used to mount the storage system on the wall.

11 Claims, 4 Drawing Sheets

STORAGE DEVICE FOR PERSONAL DENTAL HYGIENE AND ORAL CARE PRODUCTS

BACKGROUND OF INVENTION

This invention relates to a storage system for personal care products used for dental hygiene and oral care.

The recent developments in the personal care area of dental hygiene and oral care have resulted in a proliferation of products used for these purposes. Included in this group of items are toothbrushes, toothpicks, gum massagers, dental floss, toothpaste pumps and tubes, mouth mirrors, mouthwash and gargle, dentures and partial plates, denture adhesive, denture rinse and rinse cup. Many of these products are used in the bathroom and most bathrooms do not have adequate storage facilities for these products. Thus, these products are frequently placed on bathroom sink vanity tops, water closet tank and other horizontal surfaces in the bathroom. This results in confusion and unsightly clutter in the bathroom.

An another objective of this invention is to provide a storage system for personal care products used for dental hygiene and oral care usable for travel. In this invention the storage system is waterproof, can easily be constructed of rustproof material, is break and scratch resistant and is leakproof. Thus, the storage system can easily go from bathroom vanity top to suitcase.

SUMMARY OF INVENTION

The invention discloses a storage system for personal care items for dental hygiene and oral care comprising a storage tube with an interior and exterior surface and two ends, one end closed and used as the base and the other end open. A toothbrush ring with an outer and inner rim is mounted on the open end of storage tube and the outer rim of toothbrush ring extends beyond the exterior surface of the storage tube and contains a plurality of apertures on which to hang toothbrushes. The inner rim of the toothbrush ring extends inside the interior surface of the storage tube. A rinse cup with an exterior flange on the open end catches the interior rim of the toothbrush ring such that the rinse cup is stored within the storage tube and rests on the inner rim of the toothbrush ring. The invention includes a rinse cup lid which rests on the inner rim of the toothbrush ring covering the exterior flange of the rinse cup. The storage tube has a cut away opening in the side of the tube so that items can be stored within the tube and those items can be inserted into or removed through this cut away opening. Further, the storage tube can consist of upper and lower sections which are removably connected allowing separation of the two sections. This allows storage within the lower section. Alternatively, the rinse cup lid can be removably attached to the exterior rim of the toothbrush ring. Thus the toothbrushes are contained within the rinse cup lid. The means of attachment of the rinse cup lid to the toothbrush ring can be a pressure friction fit, threaded or a snap fit.

DESCRIPTION OF THE PREFERRED EMBODIMENT

Figure 1:
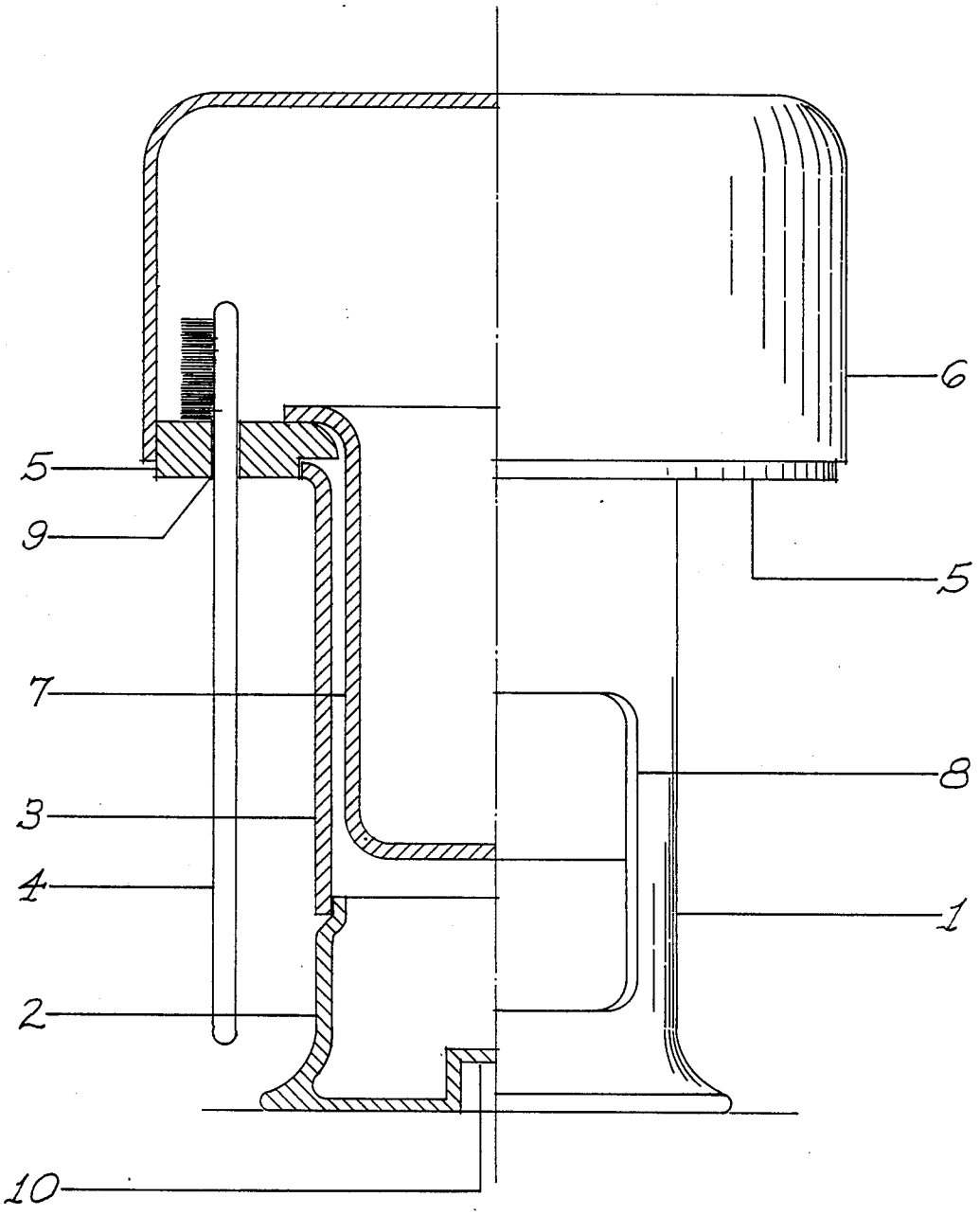
FIG. 1 is a split view with the right side being a front view of the device and the left side being a cross-section view.

In FIG. 1 the aperture 8 is shown in the storage tube 1. This aperture allows for the insertion of items to be stored and removed from the storage tube. This area can be used to store dental floss, gum massagers, denture adhesive and other items. The aperture 8 also allows for the lifting of the rinse cup 7 from its resting place on toothbrush ring 5. Other items such as toothpaste tube and pump, mouth mirror, mouthwash and gargle can be stored within the rinse cup 7. Toothbrush ring 5 rests on storage tube 1. The toothbrush ring can either be rigidly attached to the storage tube 1 or allowed to rotate about the storage tube allowing the selection of the toothbrush 4 by the user.

Alternatively the storage tube can be made in two separable sections: a lower section 2 and an upper section 3. This allows the separation of the two sections which gives the user complete access to the storage compartment within the lower section 2 of the storage tube. The means of attachment of the two sections can be a pressure friction fit, threaded or a snap fit.

The rinse cup is stored within the storage tube 1 or in the alternative within the upper section 3 and the top flange of the cup rests on the inner rim of the toothbrush ring 5. Alternatively, the rinse cup can have tapered sides and interact with the inner ring of the toothbrush ring 5. The toothbrush 4 is inserted in the aperture 9 in the toothbrush ring 5. The rinse cup lid 6 sits on the outer rim of the toothbrush ring 5 covering the bristles of the toothbrushes keeping them clean.

FIG. 1 also shows the recess hole 10 located in the base of the storage tube 1. This hole is used with the optional wall bracket to mount the storage device on a wall.

Figure 2:
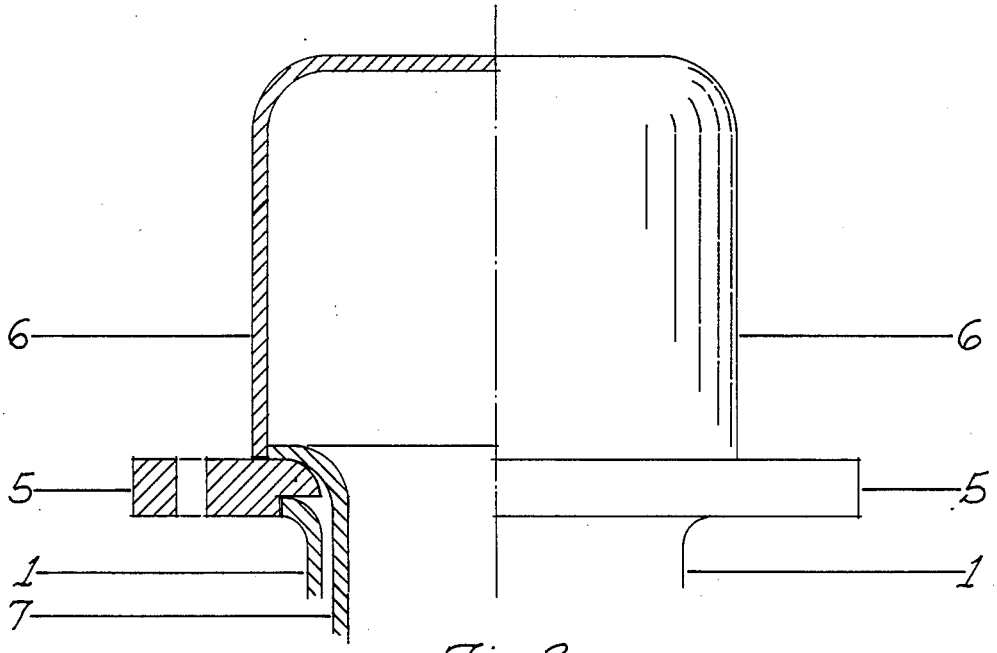
FIG. 2 is a fragmentary split view of the detail of the alternative cap with the right side being the front view and the left side a cross section view.

FIG. 2 is a fragmentary view of the alternative rinse cup. In this embodiment the rinse cup lid only covers the rinse cup 7 and the toothbrushes 4 inserted in the toothbrush ring 5 through the apertures 9 are left exposed to the environment. This exposure to the environment allows the brushes to dry quicker.

Figure 3:
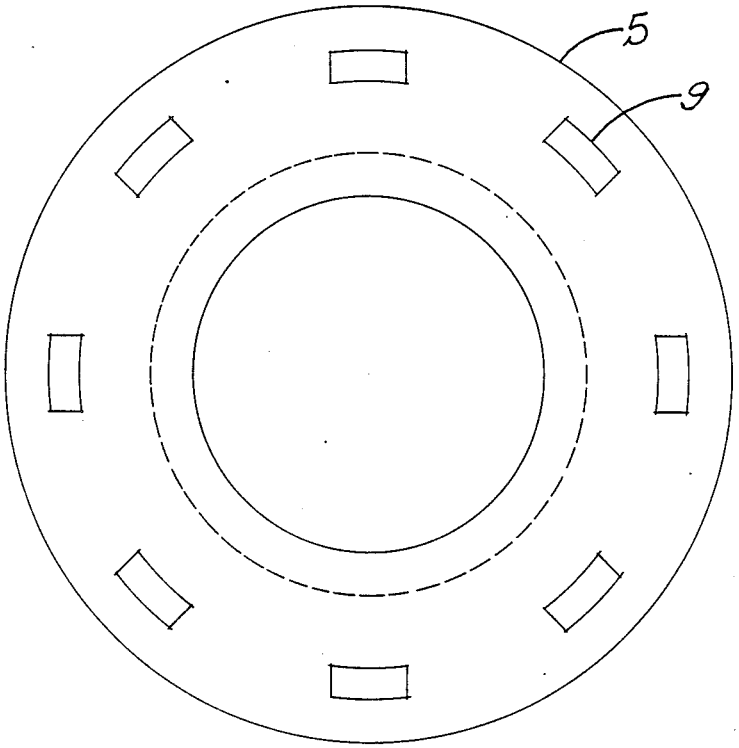
FIG. 3 is a top view of the toothbrush ring.

FIG. 3 shows the plurality of apertures 9 in the toothbrush ring 5. Alternatively, the toothbrushes can be stored in notches in the outer perimeter of toothbrush ring.

Figure 4:
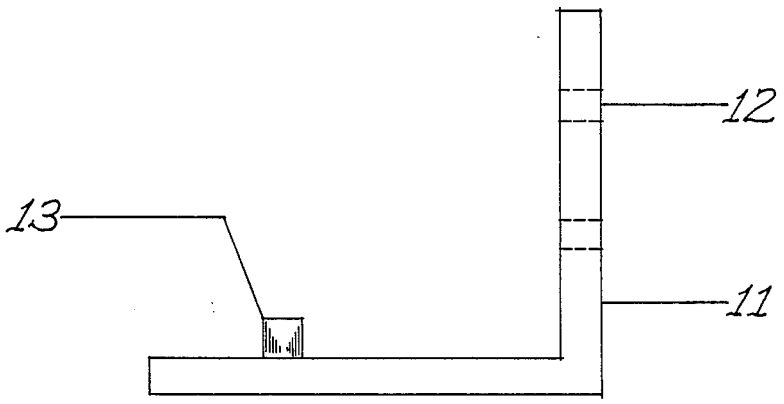
FIG. 4 is a side view of the wall bracket.

FIG. 4 shows the optional wall bracket 11. The bracket 11 is be attached to the wall with screws through the holes 12 in the bracket. Alternatively, the bracket can be adhered to the wall with double sided adhesive tape. The post 13 fits in the recess hole 10 as shown in FIG. 1. Thus the storage system can be rotated about the post 13 for selection purposes.

Figure 5:
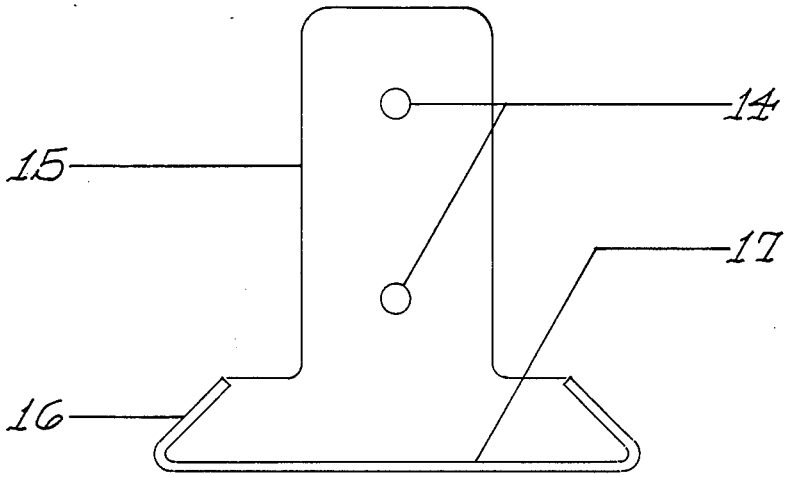
FIG. 5 is the front view of an alternate wall bracket.

FIG. 5 shows a front view of the alternate optional wall bracket 15. This bracket can be mounted to the wall with screw through the holes 14 or adhered with double adhesive tape. The storage tube rests on the bracket floor 17 and the base flare of the storage tube fits between the bracket floor 17 and the bracket lips 16. The storage tube can be rotated but can not be knocked out of the bracket.

Figure 6:
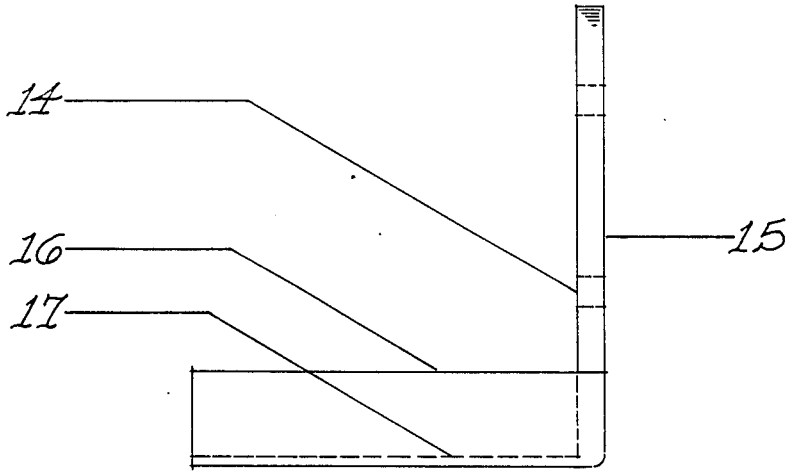
FIG. 6 is the side view of an alternate wall bracket.

FIG. 6 shows the side view of the alternate optional wall bracket 15. The holes 14 can be used to secure the bracket to the wall. The storage tube sits on the bracket base 16 and the bracket lips 16 stop the storage tube from falling out of the bracket.

I claim:

1. A storage system for personal care items for dental hygiene and oral care comprising:

a storage tube with an interior and exterior surface and two ends, one end closed and used as the base and the other end open;

a toothbrush ring with outer and inner rims mounted on the open end of storage tube, the outer rim of the toothbrush ring extends beyond the exterior surface of the storage tube and contains a plurality of apertures in which toothbrushes hang and the inner rim extends inside the interior surface of the storage tube;

a rinse cup with an exterior flange on an open end to catch the interior rim of the toothbrush ring such that the rinse cup is stored within the storage tube and rests on the inner rim of the toothbrush ring; a rinse cup lid which rests on the rim of the toothbrush ring covering the exterior flange of the rinse cup.

2. The same device as claimed in claim 1 wherein the storage tube has a cylindrical cross section.

3. The same device as claimed in claim 1 wherein the storage tube has a cut away opening so that access to items stored within the tube can be had;

4. The same device as claimed in claim 1 wherein the tube consists of upper and lower sections which are removably connected allowing separation of the two sections to allow storage within the tube.

5. The same device as claimed in claim 1 wherein a rinse cup lid is removably disposed on the exterior rim of the toothbrush ring so that the toothbrushes are contained within the rinse cup lid.

6. The same device as claimed in claim 1 wherein the rinse cup has tapered sides which catch the inner rim of the toothbrush ring.

7. The same device as claimed in claim 1 wherein the toothbrush ring is rotatable about the storage tube.

8. The same device as claimed in claim 1 wherein the toothbrush ring can rotate about the storage tube.

9. The same device as claimed in claim 1 wherein the bottom of the storage tube is flared outwardly and has a wall bracket; the wall bracket contains a plurality of retaining lips which interact with the outwardly flared portion of the storage tube.

10. The same device as claimed in claim 1 wherein the storage tube contains a recess hole in the base end of the storage tube and has a wall bracket; the wall bracket contains a locating post which is received by the recess hole in the base of the storage tube.

11. The same device as claimed in claim 1, wherein the rinse cup lid rests in close proximity to the inner rim of the toothbrush ring, and covers the exterior flange of the rinse cup but not the toothbrushes.

* * * * *